United States Patent [19]

Ando

[11] 4,242,541

[45] Dec. 30, 1980

[54] COMPOSITE TYPE ACOUSTIC TRANSDUCER

[75] Inventor: Otaro Ando, Hino, Japan

[73] Assignee: Olympus Optical Co., Ltd., Tokyo, Japan

[21] Appl. No.: 970,150

[22] Filed: Dec. 18, 1978

[30] Foreign Application Priority Data

| | | | |
|---|---|---|---|
| Dec. 22, 1977 | [JP] | Japan | 52/153565 |
| Jan. 5, 1978 | [JP] | Japan | 53/24 |
| Jan. 5, 1978 | [JP] | Japan | 53/25 |
| Nov. 7, 1978 | [JP] | Japan | 53/136942 |

[51] Int. Cl.[3] ..... H04R 23/02

[52] U.S. Cl. ..... 179/110 A; 179/111 R; 179/115.5 PV

[58] Field of Search ..... 179/110 A, 111 R, 111 E, 179/115.5 PV

[56] References Cited

U.S. PATENT DOCUMENTS

| | | | |
|---|---|---|---|
| 3,947,708 | 3/1976 | Fulenwidel | 179/110 A |
| 4,020,296 | 4/1977 | Dahlquist | 179/115.5 PV |

*Primary Examiner*—James W. Moffitt

*Attorney, Agent, or Firm*—Haseltine, Lake & Waters

[57] ABSTRACT

A composite type acoustic transducer of a flat drive type electrodynamic transducer and a piezoelectric type transducer. A diaphragm has a membrane of any suitable shape made of high molecular piezoelectric material such as polyvinylidene fluoride, an electrode layer applied on one surface of a membrane, and a coil like conductor applied on the other surface of the membrane. A supporting member supports the diaphragm along its edge. A permanent magnet device produces a magentic field extending in parallel to a plane of the diaphragm and perpendicular to the coil like conductor. When an audio signal current passes through the coil like member and an audio signal voltage is applied across the electrode layer and the coil like conductor, the piezoelectric membrane shrinks and stretches, and at the same time a force to drive the membrane in a direction perpendicular to the diaphragm is generated due to an electromagnetic interaction between the current flowing through the coil-like conductor and the magnetic field.

18 Claims, 19 Drawing Figures

COMPOSITE TYPE ACOUSTIC TRANSDUCER

BACKGROUND OF THE INVENTION

1. Field of the Invention

The present invention relates to an acoustic transducer for use in a loudspeaker, a headphone and the like, and more particularly a composite type acoustic transducer of a piezoelectric type transducer and a flat drive type electrodynamic transducer. In the piezoelectric type transducer a diaphragm comprising a membrane made of high molecular piezoelectric materail and a pair of electrode layers applied on respective surfaces of the membrane is supported in a concave or dome-shape and is caused to vibrate due to shrinkage and stretch of the membrane in accordance with an audio signal voltage applied across the electrodes. In the flat drive type electrodynamic transducer a diaphragm or membrane which has a coil-like conductor applied thereon and is arranged in parallel to a magnetic field is caused to vibrate in a homogeneous or uniform phase over the entire surface of the membrane in accordance with an audio signal current supplied to the coil-like conductor.

2. Description of the Prior Art

Heretofore there have been proposed and designed various kinds of the flat drive type electrodynamic acoustic transducers and piezoelectric type acoustic transducers. For instance Japanese Patent Publication No. 10,420/70 and U.S. Pat. No. 3,674,946 disclose the flat drive type electrodynamic acoustic transducer including a number of rod-shaped permanent magnets. Further Japanese Utility Model Laid-open Publication No. 37,625/73 and U.S. Pat. No. 3,792,204 describe the piezoelectric type acoustic transducer comprising a dome-shaped piezoelectric membrane.

FIG. 1 is a cross sectional view showing an embodiment of the known flat drive type electrodynamic acoustic transducer of a kind disclosed in the Japanese Patent Publication No. 10,420/70. A membrane 1 made of resilient material such as polyester is supported by a pair of supporting frames 2*a* and 2*b* along its edge. Openings of the frames are covered with casings 3*a* and 3*b* having a number of small apertures 4*a* and 4*b*, respectively formed therein. On inside surfaces of the casings 3*a* and 3*b* are secured a number of rod-shaped permanent magnets 5*a* and 5*b*, respectively, in parallel to each other. As shown in FIG. 1 these magnets are so arranged that the magnets opposite to each other with respect to the membrane 1 have the same polarity, but adjacent magnets have different polarities so as to form magnetic fields in parallel with the membrane 1 as shown by an arrow A. On the surface of the membrane 1 is provided a coil like conductor 6 by, for instance evaporation, in such a manner that an electric current can pass through adjacent leg portions of the coil like conductor 6 in opposite directions. When the audio signal current flows through the coil like conductor 6 there is produced a force to drive or displace the membrane 1 in a direction perpendicular to the direction A due to an electromagnetic interaction between the current and the magnetic field. In this manner the flat drive type electrodynamic acoustic transducer can reproduce an acoustic wave in accordance with the audio signal.

FIG. 2 is a cross section for illustrating an embodiment of the known piezoelectric type acoustic transducer described in the Japanese Utility Model Laid-open Publication No. 37,625/73. The transducer comprises a base plate 7 having a number of apertures 8 formed therein, a diaphragm 9 secured to the base plate 7 along its edge by means of a securing frame 10, and a resilient member 11 arranged between the base plate 7 and the diaphragm 9. The diaphragm 9 is supported along the curved surface of the resilient body 11. The diaphragm 9 consists of a membrane 12 made of high molecular piezoelectric material and a pair of electrode layers 13 and 14 applied on respective surfaces of the piezoelectric membrane 12. The electrode layers may be applied by evaporation. When an audio signal voltage is applied across the electrode layers 13 and 14, the piezoelectric membrane 12 is caused to shrink and stretch in a direction shown by an arrow B in accordance with the audio signal and as a result the diaphragm 9 vibrates in a direction perpendicular to the direction B so as to produce an acoustic wave.

In the known acoustic transducers, since the driving force is produced at every portion of the membrane or diaphragm in a substantially same direction and thus the membrane vibrates in a homogeneous phase, the ideal piston motion of the diaphragm is realized and thus a reproduction characteristic of the transducer is superior to that of ordinary cone-type electrodynamic transducer. Particularly a distortion of the flat drive type electrodynamic transducer is materially smaller than the cone type electrodynamic transducer. Further the flat drive type electrodynamic transducer has a very flat sound level/frequency response.

However in the known flat drive type electrodynamic transducer as shown in FIG. 1 it is very difficult to produce a sufficiently large magnetic flux density due to its construction and thus an efficiency is rather low. Also in the known piezoelectric type transducer illustrated in FIG. 2 any piezoelectric material having a sufficiently high piezoelectric modulus could not be found and therefore the efficiency is also low. Further in the known transducers since the diaphragm is suspended under a certain tension an amplitude of vibration is rather small and a sufficient reproduction of lower frequency sound could not be attained. For instance, in the transducer shown in FIG. 1, the membrane 1 is always stretched in the direction A and thus there is always produced a force which limits the displacement of the membrane in the direction perpendicular to the direction A. This results in the decrease in the efficiency and vibration amplitude and therefore the reproduction characteristic in the lower frequency range might be deteriorated. Under the above circumstances an application of such transducers has been usually limited only to a headphone and a tweeter.

SUMMARY OF THE INVENTION

The present invention has for its object to provide an acoustic transducer which has a novel composite construction of the flat drive type electrodynamic transducer and of the piezoelectric type transducer and has an excellent properties such as a high efficiency, a large vibration amplitude and a sufficient sound reproduction in the low frequency range, while maintaining the advantages inherent to the flat drive type transducer and the piezoelectric type transducer.

According to the invention, a composite type acoustic transducer of a flat drive type electrodynamic transducer and of a piezoelectric type transducer comprises a diaphragm which includes a membrane made of high molecular piezoelectric material, an electrode layer applied on one surface of the membrane and a coil-like conductor applied on the other surface of the membrane;

means for supporting the diaphragm along its edge;

means for forming a magnetic field which extends in parallel with the diaphragm and cooperates electromagnetically with the coil-like conductor;

means for supplying an audio signal current through said coil-like conductor; and means for applying a voltage related to an audio signal to be reproduced across the electrode layer and the coil-like conductor.

DESCRIPTION OF THE PREFERRED EMBODIMENTS

Figure 1:
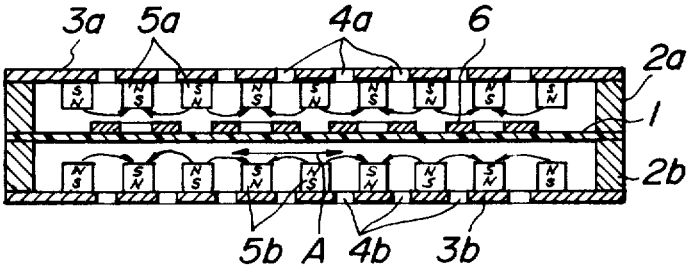
FIG. 1 PRIOR ART
FIG. 1 is a cross-section showing a known flat drive type electrodynamic acoustic transducer.
Figure 2:
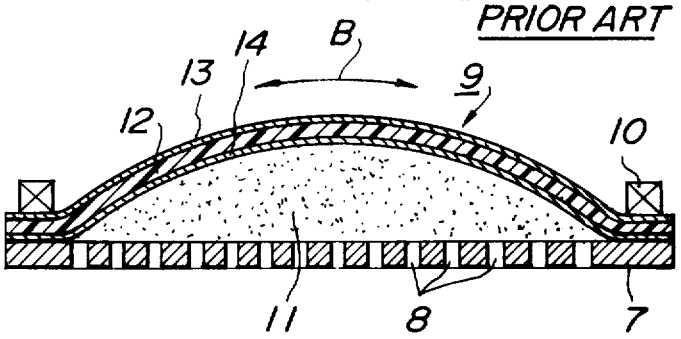
FIG. 2 PRIOR ART
FIG. 2 is a cross-section illustrating a known piezoelectric type acoustic transducer.
Figure 3:
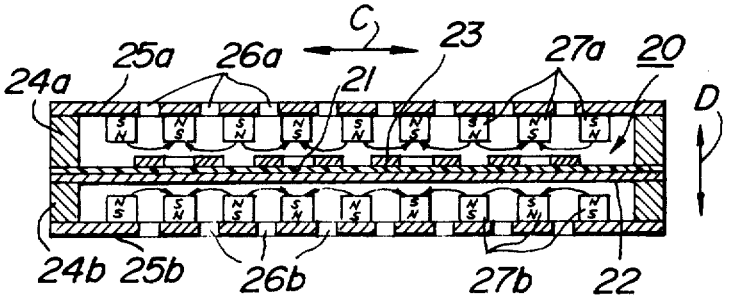
FIG. 3 is a cross-sectional view depicting an embodiment of a composite type acoustic transducer according to the invention.
Figure 4:
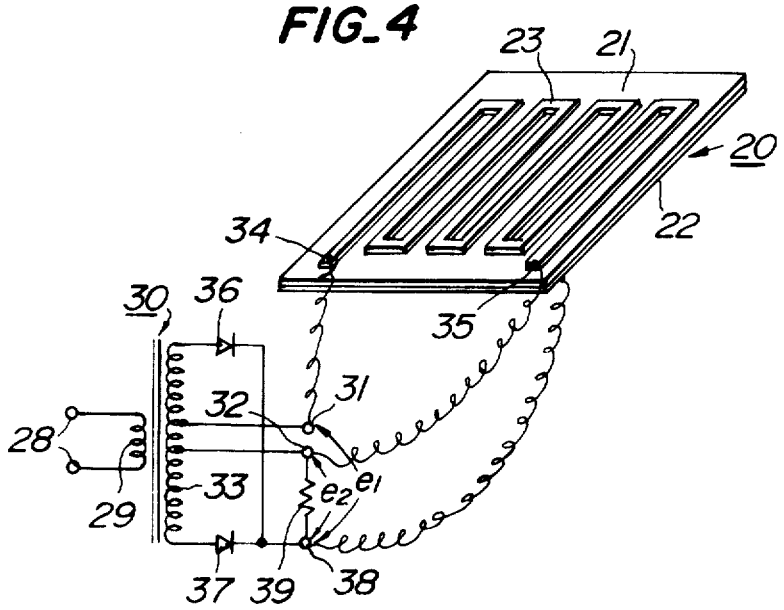
FIG. 4 is a perspective view showing a diaphragm of the transducer of FIG. 3 together with its driving circuit.

FIG. 3 is a cross-sectional view depicting an embodiment of the composite type acoustic transducer according to the invention. The transducer comprises a diaphragm 20 having a membrane 21 made of high molecular piezoelectric material such as polyvinylidene fluoride (PVDF), an electrode layer 22 applied on one surface of the membrane and a coil-like conductor 23 applied on the other surface of the membrane 21. The electrode layer 22 and coil-like conductor 23 may be formed by any suitable process such as evaporation, sticking, and printing. In this embodiment the coil-like conductor 23 is of a zig-zag form as shown in FIG. 4. The rectangular diaphragm 20 is supported in flat between a pair of frames 24*a* and 24*b* along its edge. Upper and lower openigs of the frames are covered by plates 25*a* and 25*b*, respectively, having a number of apertures 26*a* and 26*b*, respectively. The cover plates 25*a* and 25*b* are made of magnetic material so as to serve as a magnetic yoke. On inner surfaces of respective plates 25*a* and 25*b* are secured a plurality of permanent magnets 27*a* and 27*b* of rod-shape. These magnets extend in parallel to leg portions of the coil like conductor 23 and situate intermediately between successive legs of the conductor 23. The magnets 27*a* and 27*b* are so arranged that adjacent poles have different polarities and poles opposite to each other with respect to the diaphragm 20 have the same polarity. Therefore, there is formed a magnetic field which is parallel to the diaphragm and is perpendicular to the leg portion of the coil-like conductor 23.

FIG. 4 illustrates a manner of supplying an audio signal to be reproduced as well as a perspective view of the diaphragm 20 shown in FIG. 3. In the transducer according to the invention, an audio signal voltage is applied to the coil-like conductor 23 from a low impedance signal source so as to flow a relatively large audio signal current through the conductor 23. The diaphragm 20 is caused to vibrate due to a force produced by an electromagnetic interaction between the signal current and the magnetic field. Across the conductor 23 and the electrode layer 22 is applied a voltage obtained by full-wave rectifying the audio signal voltage, i.e. a voltage proportional to an absolute value of the audio signal voltage, from a high impedance signal source. The polarity of the voltage applied across the electrode layer 22 and the conductor 23 is so selected that the membrane 21 stretches upon the application of the voltage. When the rectified audio signal voltage is applied, the membrane 21 stretches in a direction shown by an arrow C in FIG. 3, i.e., a direction parallel to a plane of the membrane 21 and thus the diaphragm 20 can displace easily in a direction shown by an arrow D in FIG. 3, i.e., a direction perpendicular to the diaphragm. During the displacement of diaphragm 20 the tension of the membrane 21 is reduced and therefore the vibration of the diaphragm 20 is not suppressed. An amount of stretch of membrane 21 may be suitably determined by adjusting an amplitude of the voltage applied across the electrode layer 22 and the conductor 23.

In the embodiment shown in FIG. 4 an audio signal to be reproduced is supplied to input terminals 28 connected to a primary winding 29 of a transformer 30 from an audio amplifier (not shown). Low impedance output terminals 31 and 32 connected to a secondary winding 33 are connected to both ends 34 and 35 of the coil like conductor 23 respectively. To the secondary winding 33 are connected diodes 36 and 37 so as to produce a full-wave rectified audio signal voltage at the high impedance output terminals 32 and 38 across which a resistor 39 is connected. The high impedance terminal 38 is connected to the electrode layer 22. A winding ratio of the transformer 30 and a polarity of the diode 36 and 37 are so selected that the proper amount and direction of stretch of the membrane 21 can be attained. The resistor 39 serves as a discharging resistor. The diaphragm 20 constitutes a capacitance and the positive and negative potentials are applied to the electrode layer 22 and the conductor 23, respectively. Therefore the diaphragm is charged always in the same polarity. The charge stored in the diaphragm could not pass through the diodes 36 and 37. Thus if the resistor 39 is not connected across the terminals 32 and 38, the voltage applied across the membrane 21 will be a smoothed full-wave rectified voltage i.e. a d.c. voltage having substantially no amplitude variation and therefore the membrane 21 does not stretch in proportion to the absolute value of the input audio signal. Now it is assumed that C is an electrostatic capacitance of the diaphragm 20, R a resistance value of the resistor 39 and fmax is the highest reproduction frequency. The highest frequency of the full-wave rectified wave becomes 2· fmax and a time constant CR of the capacitance C and the resistance R should be smaller than ½ fmax. Therefore, the resistance R of the resistor 39 has to satisfy the following relation.

$$R < 1/2 \cdot C \cdot fmax$$

If the resistance value R is made smaller, the voltage applied to the diaphragm 20 follows the full-wave rectified waveform of the input audio signal, but a power loss wasted at the resistor 39 becomes large. Therefore, it is preferable to use the resistor having a resistance as large as possible as long as a given fidelity can be maintained.

The low impedance terminals 31 and 32 are arranged near the middle point of the secondary winding 33, so that the voltage across the electrode layer 22 and the conductor 23 can be proportional substantially to the absolute value of the audio signal voltage. But, in practice, a potential on the coil-like conductor 23 varies in accordance with a position thereon. A voltage $e_1$ applied between the electrode 22 and the terminal 34 is slightly different from the voltage $e_2$ applied across the electrode 22 and the terminal 35. However the difference between these voltages is very small and therefore could not substantially affect the proper operation of the transducer. Further, a forward voltage drop across the diodes 36 and 37 is also very small as compared with the voltage applied across the electrode layer 22 and the coil-like conductor 23.

Figure 5:
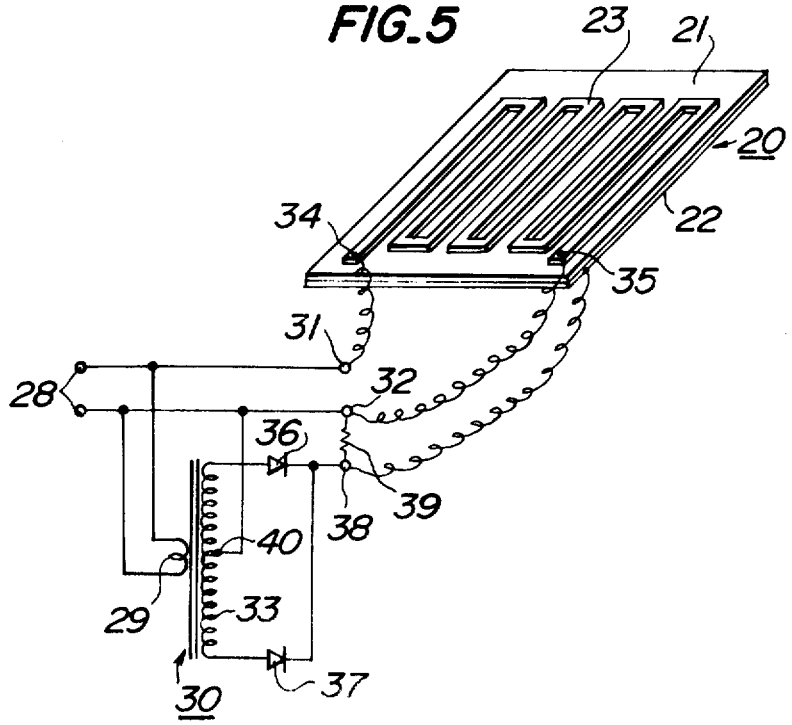
FIG. 5 illustrates another embodiment of the driving circuit.

FIG. 5 shows another embodiment of the circuit for driving the acoustic transducer according to the invention. The construction of the transducer itself is identical with that of the previous embodiment shown in FIG. 3. In this embodiment the voltage applied to the coil-like conductor 23 is derived from the primary side of the transformer 30. For this purpose the inut terminals 28 are connected to the terminals 34 and 35 of the conductor 23 by means of the low impedance terminals 31 and 32. The full-wave rectified voltage appears across the resistor 39 connected between the high impedance output terminals 32 and 38. The common terminal 32 is connected to a center tap 40 provided on the secondary winding 33.

The driving circuit may be constructed in various manner. For example, instead of the transformer an amplifier for supplying the audio signal current through the coil-like conductor 23 and an amplifier for applying the audio signal voltage across the electrode layer 22 and the conductor 23 may be provided separately.

Figure 6A:
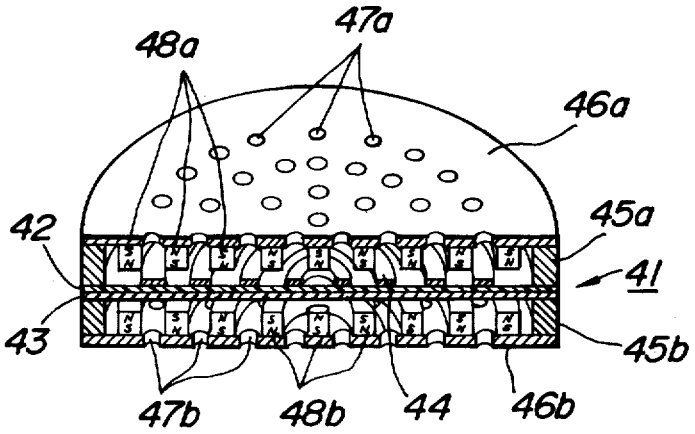
FIG. 6*a* is a perspective view showing another embodiment of the transducer according to the invention.
Figure 6B:
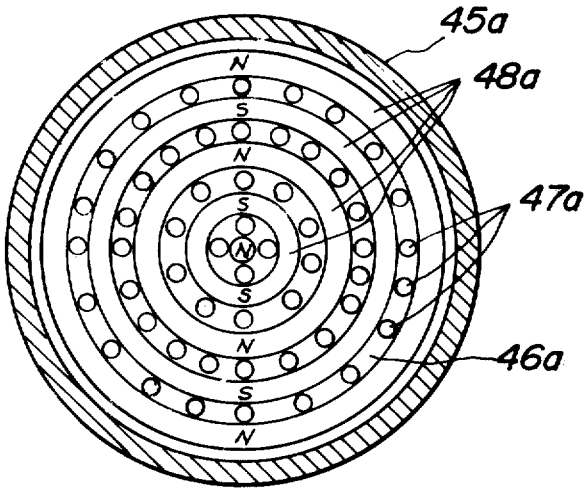
FIG. 6*b* is a plan view depicting a permanent magnet assembly of the transducer shown in FIG. 6*a;*

FIG. 6*a* is a perspective view showing another embodiment of the acoustic transducer according to the invention. In this embodiment a diaphragm 41 comprising a piezoelectric membrane 42, an electrode layer 43 and a coil-like conductor 44 is formed in a circular shape. The coil-like conductor 44 comprises a plurality of concentric circular leg portions. The diaphragm 41 is supported by a pair of ring-shaped frames 45*a* and 45*b* along its edge. Upper and lower openings of the frames are closed by disc-shaped plates 46*a* and 46*b*, respectively, made of magnetic material. The plates have formed therein a number of small apertures 47*a* and 47*b*. To inner surfaces of the disc plates 46*a* and 46*b* are secured a plurality of ring shaped permanent magnets 48*a* and 48*b*, respectively. These magnets form a magnetic field extending substantially in parallel to the diaphragm 41 together with the disc plates 46*a* and 46*b* serving as the magnetic yokes. FIG. 6*b* is a plan view showing the assembly of the frame 45*a*, the disc plate 46*a* and the magnets 48*a*.

Figure 7:
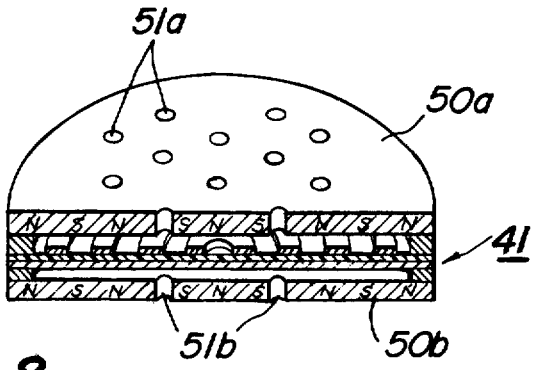
FIG. 7 is a perspective view illustrating another embodiment of the transducer according to the invention.

FIG. 7 is perspective view illustrating another embodiment of the acoustic transducer according to the invention. The construction of this transducer is substantially similar to the embodiment shown in FIG. 6. In this embodiment instead of the ring-shaped magnets 48*a* and 48*b* use are made of disc shaped magnets 50*a* and 50*b* having a number of apertures 51*a* and 51*b* formed therein, respectively. The disc-shaped magnets 50*a* and 50*b* have been magnetized concentrically in accordance with a given pattern.

Figure 8:
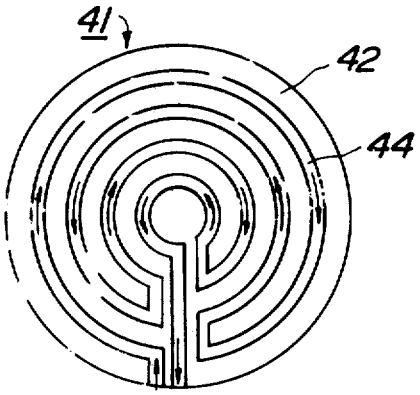
FIGS. 8 and 9 are plan views showing two embodiments of a pattern of a coil like conductor provided in the transducer according to the invention.
Figure 9:
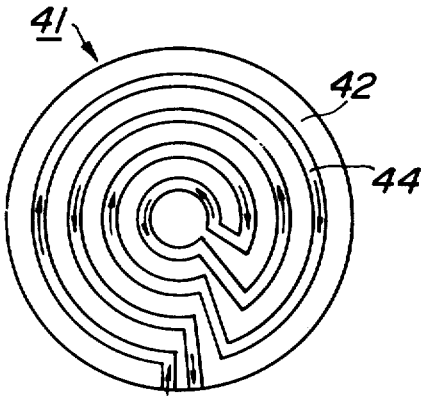

FIGS. 8 and 9 are plan views showing a pattern of the coil-like conductor 44 of the diaphragm 41 which may be used in the transducers shown in FIGS. 6 and 7. In both embodiments adjacent leg portions of the conductor 44 conduct the audio signal current in opposite directions alternately.

Figure 10:
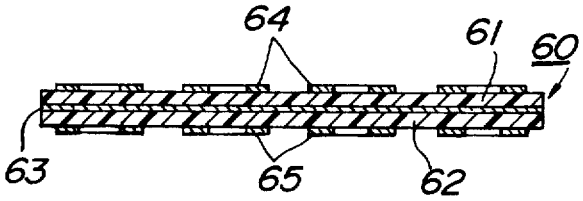
FIG. 10 is a cross-section depicting another embodiment of the diaphragm according to the invention.

FIG. 10 is a cross-sectional view illustrating another embodiment of the diaphragm according to the invention. A diaphragm 60 comprises two sheets of piezoelectric membranes 61 and 62, a common electrode layer 63 sandwiched between the membranes 61 and 62 and two coil-like conductors 64 and 65 applied on outer surfaces of the membranes 61 and 62, respectively. The diaphragm 60 can be driven in such a manner that forces produced by interaction between the magnetic fields and the audio signal currents flowing through the coil-like conductors 64 and 65 have always the same direction. For this purpose, the conductors 64 and 65 may be connected in series with or parallel to each other depending on the construction of the driving circuit to be used. Further, the voltage proportional to the absolute value of the audio signal voltage is applied across the electrode layer 63 and the coil-like conductors 64 and 65 in such a manner that the piezoelectric membranes 61 and 62 stretch simultaneously upon the application of the voltages.

Figure 11:
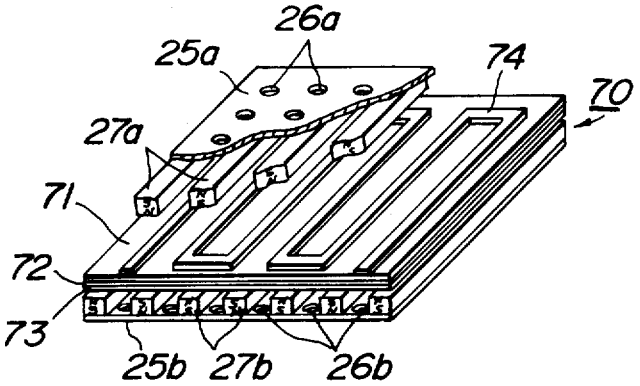
FIG. 11 is a partially cut-away perspective view showing another embodiment of the transducer according to the invention.

FIG. 11 is a partially cut away perspective view showing another embodiment of the acoustic transducer, according to the invention. The construction of the present transducer is substantially same as the transducer illustrated in FIG. 3, except for the structure of a diaphragm 70. The diaphragm 70 of this embodiment comprises laminated piezoelectric membranes 71 and 72 of a bimorph construction, an electrode layer 73 applied on a surface of the membrane 72, and a coil like conductor 74 applied on the membrane 71. These membranes 71 and 72 have polarization directions opposite to each other (see FIG. 12). The diaphragm 70 and the magnetic plates 25*a* and 25*b* having the magnets 27*a* and 27*b* secured thereto, respectively are supported in position by means of a suitable member such as the frames 24*a* and 24*b* shown in FIG. 3.

Now the operation of the present transducer will be explained with reference to FIG. 12. When the audio signal current is supplied to the coil-like conductor 74 in the direction shown in FIG. 12, the conductor 74 is subjected to a force having a direction shown by an arrow E. At the same time the audio signal voltage is applied across the electrode layer 73 and the conductor 74 and as a result the upper membrane 71 stretches as shown by an arrow F, but the lower membrane 72 shrinks as illustrated by an arrow G. Therefore, the diaphragm is subjected to a force which bends the membranes 71 and 72 upward, i.e., in the direction E. In this manner the two kinds of forces for driving the diaphragm 70 have the same direction E and thus the diaphragm 70 can move or displace to a great extent by the cooperation of the two kinds of driving forces. It is matter of course that when the current flows through the conductor 74 in the opposite direction, the diaphragm 70 is subjected to a force in the direction opposite to the direction E. In this case the upper and lower membranes 71 and 72 shrinks and stretches, respectively, so that the diaphragm 70 tends to bend downwardly.

Figure 12:
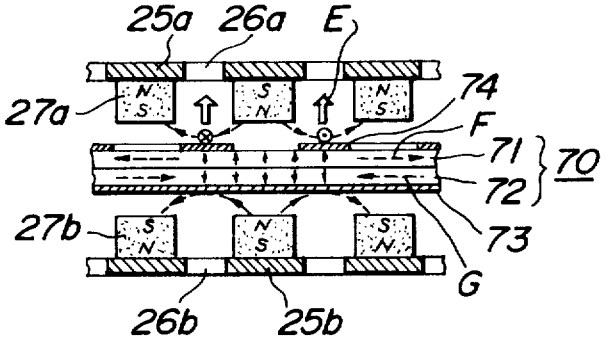
FIG. 12 is a cross section showing a portion of the transducer of FIG. 11 for explaining the operation thereof.
Figure 13:
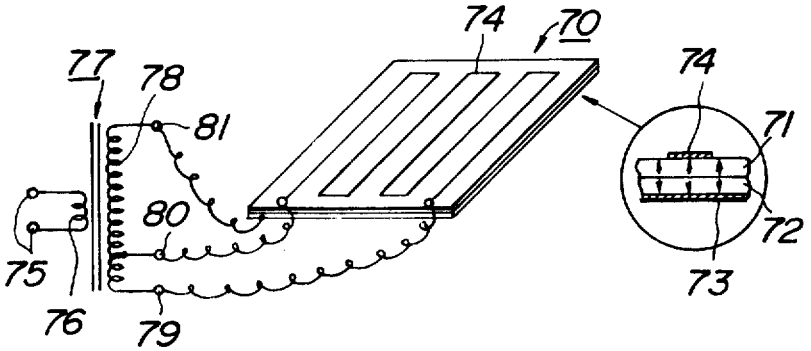
FIG. 13 shows a driving circuit for the transducer shown in FIG. 12.

FIG. 13 is a circuit diagram showing an embodiment of the driving circuit for the transducer illustrated in FIG. 12. An audio signal is supplied to input terminals 75 connected to a primary winding 76 of a transformer 77. Both ends of the coil-like conductor 74 are connected to low impedance output terminals 79 and 80 connected to a smaller portion of a secondary winding 78. The electrode layer 73 is connected to a high impedance output terminal 81 so as to apply a voltage corresponding to the input audio signal across the electrode layer 73 and the coil like conductor 74. A winding ratio and an impedance of the transformer 77 are so selected that the diaphragm 70 can vibrate with large amplitude, high efficiency and low distortion.

Figure 14:
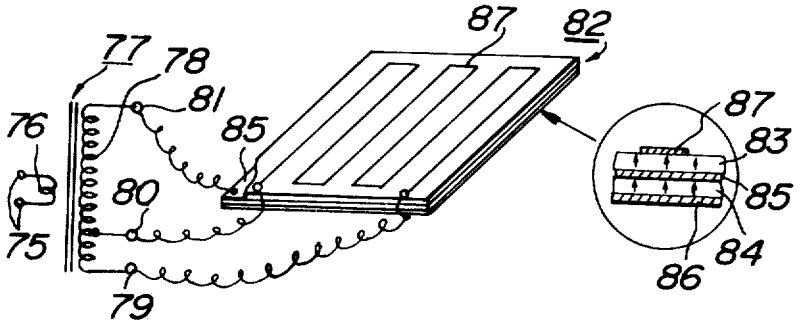
FIGS. 14 and 15 illustrate two embodiments of the transducer according to the invention together with their driving circuits.

FIG. 14 shows another embodiment of the diaphragm according to the invention. A diaphragm 82 comprises first and second piezoelectric membranes 83 and 84 having the same polarization direction, a first electrode layer 85 interposed between the first and second membranes, a second electrode layer 86 applied on an outer surface of the second membrane 84 and a coil-like conductor 87 applied on an outer surface of the first membrane 83. As shown in the drawing the second electrode layer 86 is connected to one end of the coil like conductor 87 and is connected to a low impedance output terminal 79 of a secondary winding 78 of a transformer 77. A common output terminal 80 is connected to the other end of the conductor 87. A high impedance output terminal 81 is connected to the first electrode layer 85 of the diaphragm 82. When the amplified audio signal is supplied to the input terminals 75 connected to the primary winding 76, the membranes 83 and 84 stretch and shrink, respectively, and vice versa and thus the diaphragm 82 is caused to bend upward and downward. This bending force is added with the force produced by the interaction between the magnetic field and the current passing through the coil-like conductor 87.

Figure 15:
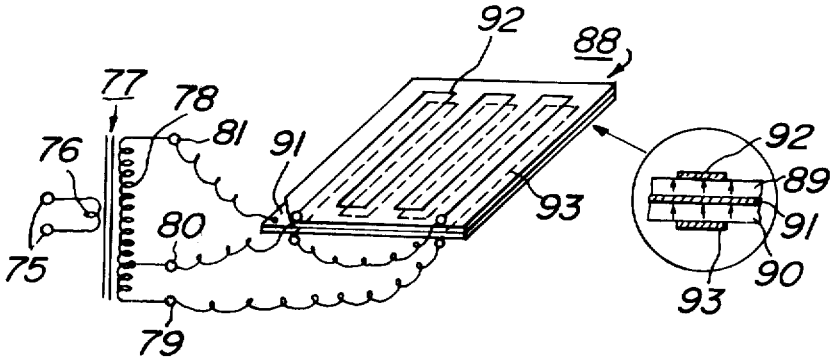

FIG. 15 illustrates still another embodiment of the diaphragm according to the invention together with its driving circuit. In this embodiment a diaphragm 88 comprises first and second piezoelectric membranes 89 and 90 having the same polarization direction, an intermediate electrode layer 91 sandwiched between the membranes, and first and second coil-like conductors 92 and 93. As shown in FIG. 15 one end of the first conductor 92 is connected to one end of the second conductor 93, the other end of which is connected to the low impedance output terminal 79. The other end of the first conductor 92 is coupled with the common output terminal 80 and the high impedance output terminal 81 is connected to the electrode layer 91. In this embodiment, since a pair of coil-like conductors 92 and 93 are provided on both surfaces of the diaphragm 88 the magnetic field can be utilized effectively. In the present embodiment, upon the application of the audio signal voltage to the diaphragm 88, the upper membrane 89 shrinks and the lower membrane 90 stretches and vice versa simultaneously. While in the embodiment shown in FIG. 10 the two membranes 61 and 62 stretch simultaneously upon the application of the full-wave rectified audio signal voltage.

In the embodiments shown in FIGS. 11 to 15 the diaphragms has the rectangular shape, but it may be formed in a circular shape just as the embodiment illustrated in FIGS. 6*a* and 7.

Figure 16:
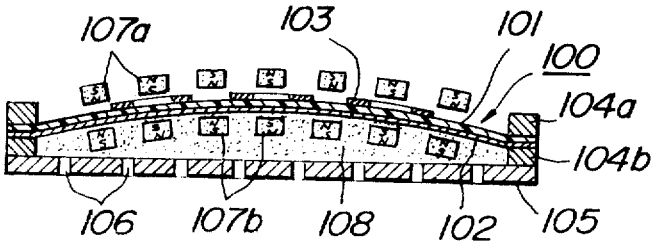
FIG. 16 is a cross section showing still another embodiment of the transducer according to the invention.

FIG. 16 is a cross-sectional view illustrating still another embodiment of the acoustic transducer according to the invention. The transducer of this embodiment comprises a diaphragm 100 of rectangular shape having a piezoelectric membrane 101, an electrode layer 102 applied on one surface of the membrane and a coil-like conductor 103 applied on the other surface of the membrane. The diaphragm 100 is supported along its edge by a pair of frames 104*a* and 104*b*. The assembly is then mounted on a base plate 105 having a number of apertures 106 formed therein. On both sides of the diaphragm 100 are arranged a plurality of rod-shaped permanent magnets 107*a* and 107*b* which form a magnetic field extending along the diaphragm 100. The magnets are fixed in position by means of a suitable supporting member (not shown). In this embodiment a resilient body 108 made of polyurethane foam and having a curved surface is inserted between the diaphragm 100 and the base plate 105. Therefore, the diaphragm 100 is supported along the curved surface of the resilient body 108.

Figure 17:
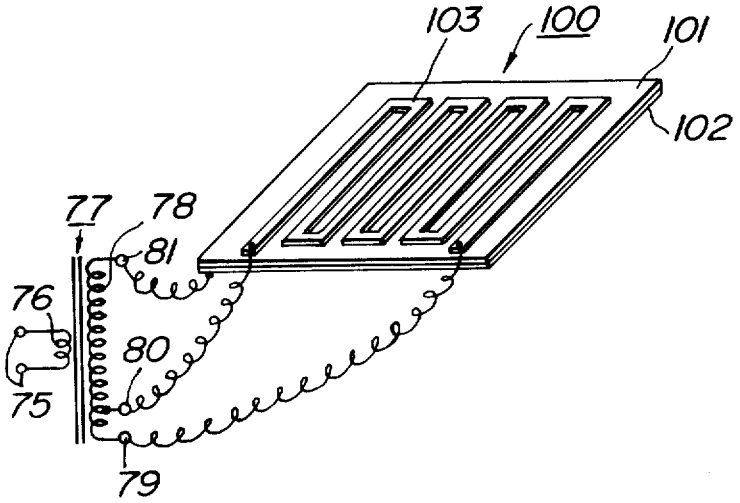
FIG. 17 depicts a circuit for driving the transducer shown in FIG. 16.

FIG. 17 shows a driving circuit for the diaphragm 100 illustrated in FIG. 16. An input audio signal is supplied to input terminals 75 connected to a primary winding 76 of a transformer 77. Low impedance output terminals 79 and 80 connected to a small portion of a secondary winding 78 of the transformer are coupled to both ends of the coil-like conductor 103 of the diaphragm 100, respectively. A high impedance output terminal 81 is connected to the electrode layer 102. An impedance between the electrode layer 102 and the conductor 103 is high and usually has a value of several KΩ to several tens KΩ, while an impedance of the conductor 103 is low such as several ohms to several tens ohms. When the audio signal current flows through the conductor 103, it is caused to displace in a direction perpendicular to the diaphragm 100 due to an electromagnetic interaction between the electric current and the magnetic field. At the same time when the audio signal voltage is applied across the electrode layer 102 and the conductor 103, the piezoelectric membrane 101 shrinks and stretches. Since the diaphragm 100 is held along the curved surface of the resilient body 108 the above shrinkage and stretch of the diaphragm 100 produce a force to drive the diaphragm in the direction perpendicular thereto. In this case it is matter of course that the two kinds of driving forces have the same direction and thus the diaphragm can vibrate in a homogeneous phase with a large amplitude.

Figure 18:
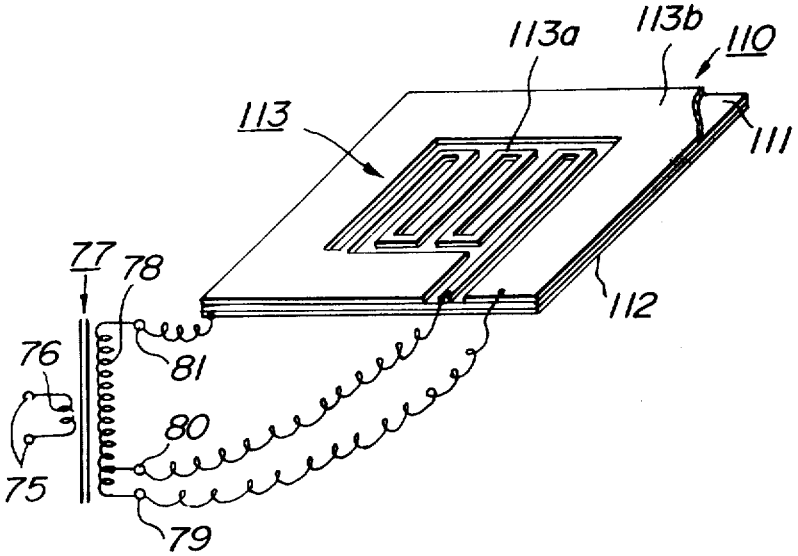
FIG. 18 is a perspective view illustrating still another embodiment of the diaphragm according to the invention together with its driving circuit.

FIG. 18 illustrates a modified embodiment of the diaphragm shown in FIG. 17. A diaphragm 110 of this embodiment comprises a piezoelectric membrane 111, an electrode layer 112 applied on one surface of the membrane 111, and a conductor 113 consisting of a central coil like portion 113*a* and a peripheral electrode portion 113*b* which has a relatively large width. Therefore magnets may be arranged only at a central portion of the transducer and thus the whole construction can be made simple and small. Particularly a thickness of the peripheral portion of the transducer can be made thin. The peripheral portion does not operate as the flat driving type electrodynamic transducer, but as the piezoelectric type transducer. FIG. 18 also illustrates a driving circuit which is the same as that shown in FIG. 17.

As explained above, the acoustic transducer according to the present invention, has a very high efficiency and a very large vibration amplitude and thus can reproduce a lower frequency sound with large volume due to a multiplicative effect of the piezoelectric type transducer and flat drive type electrodynamic transducer, while the low distortion and the flat frequency response which are inherent to the flat drive type electrodynamic transducer could be retained as they were. Further, the construction of the transducer of the invention is substantially similar to the known flat drive type electrodynamic transducer. The acoustic transducer according to the invention is suitable not only for the headphone, but also for various kinds of loudspeakers.

It should be notes that the present invention is not limited to the embodiments explained above, but many modifications can be conceived within the scope of the invention. For instance, the pattern of the coil-like conductor is not limited to the zig-zag and concentrical shape, but may be of any desired shape. In any case the pattern of the permanent magnets should be corresponded to the pattern of the coil-like conductor. Further, in the above embodiments one of the magnet array, preferably the array which does not face the coil like conductor may be omitted. Moreover in the embodiments shown in the drawings the coil like conductor is commonly used as the electrode for applying the voltage cross the piezoelectric membrane, but any suitable electrode for applying the voltage may be provided on the membrane separately from the coil-like conductor. Further, the diaphragm may be constructed in any suitable shape other than the rectangular and circular shapes. The diaphragm may include more than two piezoelectric membranes.

In the embodiment shown in FIG. 16 the diaphragm is supported along the curved surface of the resilient body 108, but it may be suspended along a curved plane by introducing a gas having a higher pressure than an atmospheric pressure into an air tightly-closed space between base plate and the diaphragm. Further, in the embodiment shown in FIG. 16 the body 108 may be made of material other than polyurethane foam such as glass fiber wools, felt, etc., which are commonly used as acoustic damping material. It is not always necessary that the body 108 has the curved surface. For instance, the body 108 may have a flat surface. Even in such a case the body 108 may be deformed by tension caused by stretching the membrane 100 and thus the membrane is supported along a curved plane.

It is also possible to selectively supply the audio signal current and voltage to the transducer by means of a suitable switch. Then the acoustic transducer, according to the invention, can be selectively operated as the piezoelectric type transducer and the flat drive type electrodynamic transducer as well as the composite type transducer so as to satisfy, user's interest in tone quality of reproduced sound.

What is claimed is:

1. A composite type acoustic transducer of a flat drive type acoustic transducer and of a piezoelectric type acoustic transducer comprising:

a diaphragm including a membrane made of high molecular piezoelectric material, an electrode layer applied on one surface of the membrane and a coil-like conductor applied on the other surface of the membrane;

means for supporting the diaphragm along its edge;

means for forming a magnetic field extending in parallel with the diaphragm and cooperating electromagnetically with the coil-like conductor;

means for supplying an audio signal current through said coil-like conductor; and means for applying a voltage related to an audio signal to be reproduced across the electrode layer and the coil-like conductor.

2. A composite type acoustic transducer according to claim 1, wherein the diaphragm is supported in flat and the voltage applied across the electrode layer and the coil-like conductor is of a full-wave rectified audio signal voltage, whereby the diaphragm is caused to stretch upon the application of the voltage.

3. A composite type acoustic transducer according to claim 2 further comprising a resistor connected across the electrode layer and the coil like conductor, said resistor having a resistance value R smaller than 1/2C·f-max, wherein C is a capacitance of the piezoelectric membrane and famx is the highest reproduction frequency.

4. A composite type acoustic transducer according to claim 1, wherein said diaphragm has a bimorph construction having at least two laminated piezoelectric membranes, and polarizing directions of the piezoelectric membranes and polarities of voltages applied across the membranes are so determined that at least one of the membranes stretches and the other one or more membranes shrink and vice versa upon the application of the voltages so as to generate a force for bending the diaphragm in the same direction as that of the force produced by the electromagnetic interaction between the magnetic field and the current flowing through the coil-like conductor.

5. A composite type acoustic transducer according to claim 4, wherein said diaphragm of bimorph construction comprises a first piezoelectric membrane having a first polarization direction, a second piezoelectric membrane having a second polarization direction which is opposite to the first direction, an electrode layer applied on the surface of the first membrane and a coil-like conductor applied on the surface of the second membrane.

6. A composite type acoustic transducer according to claim 4, wherein said diaphragm comprises first and second piezoelectric membrane having the same polarization direction, a first electrode layer sandwiched between the first and second membranes, a second electrode layer applied on the surface of the first membrane and a coil-like conductor applied on the surface of the second membrane.

7. A composite type acoustic transducer according to claim 4, wherein said diaphragm comprises first and second piezoelectric membranes having the same polarization direction, an electrode layer sandwiched between the first and second membranes, and first and second coil-like conductors applied on the surfaces of the first and second membranes, respectively.

8. A composite type acoustic transducer according to claim 1, wherein said diaphragm is supported along a curved plane and a force perpendicular to the diaphragm is generated due to the stretch and shrinkage of the membrane upon the application of the voltage.

9. A composite type acoustic transducer according to claim 8 further comprising a resilient body on which the diaphragm is placed.

10. A composite type acoustic transducer according to claim 9, wherein the resilient body has a curved surface on which said diaphragm is situated.

11. A composite type acoustic transducer according to claim 8, wherein said coil-like conductor comprises a coil-like portion situated at a centeral portion of the diaphragm and an electrode layer portion situated at a peripheral portion of the diaphragm.

12. A composite type acoustic transducer according to claim 1, wherein said coil-like conductor includes a plurality of leg portions which are connected in a zigzag manner and extend in parallel with each other and said magnetic field forming means comprise a plurality of rod-shaped permanent magnets which arranged on a plane parallel to the diaphragm and extending in parallel with each other in the same direction as that of the leg portions of the coil-like conductor, the adjacent magnets having polarities opposite to each other.

13. A composite type acoustic transducer according to claim 12 further comprising at least one plate made of magnetic material and having a number of apertures formed therein, wherein said magnetic plate is arranged in parallel with the diaphragm and the magnets are secured onto an inner surface of the magnetic plate.

14. A composite type acoustic transducer according to claim 12, wherein said permanent magnets are formed by an integral magnetic plate which has been magnetized in accordance with a given pattern.

15. A composite type acoustic transducer according to claim 1, wherein said coil-like conductor comprises a plurality of concentric circular leg portions and said magnetic field forming means comprise a plurality of ring-shaped permanent magnets which are arranged concentrically on a plane parallel to the diaphragm, the adjacent magnets having polarities opposite to each other.

16. A composite type acoustic transducer according to claim 15 further comprising at least one plate of magnetic material arranged in parallel to the diaphragm and having a number of apertures formed therein, wherein said magnets are secured to the inner surface of the magnetic plate.

17. A composite type acoustic transducer according to claim 15, wherein said magnets are composed of an integral magnetic plate which has been magnetized in accordance with a given pattern.

18. A composite type acoustic transducer according to claim 1, wherein said diaphragm has one of rectangular, circular, oval and elliptical shapes.

* * * * *